US006568652B2

(12) United States Patent
Kaiser et al.

(10) Patent No.: US 6,568,652 B2
(45) Date of Patent: May 27, 2003

(54) THROTTLE VALVE RESTORING DEVICE

(75) Inventors: Klaus Kaiser, Markgroeningen (DE); Uwe Hammer, Hemmingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/979,211

(22) PCT Filed: Mar. 20, 2001

(86) PCT No.: PCT/DE01/01063

§ 371 (c)(1),
(2), (4) Date: May 17, 2002

(87) PCT Pub. No.: WO01/71173

PCT Pub. Date: Sep. 27, 2001

(65) Prior Publication Data

US 2002/0162982 A1 Nov. 7, 2002

(30) Foreign Application Priority Data

Mar. 21, 2000 (DE) ..... 100 13 917

(51) Int. Cl.[7] ..... F02D 9/02
(52) U.S. Cl. ..... 251/69; 251/70
(58) Field of Search ..... 251/67–74

(56) References Cited

U.S. PATENT DOCUMENTS 3,704,635 A * 12/1972 Eshelman ..... 251/67
3,785,615 A * 1/1974 Haen ..... 251/74
6,155,533 A * 12/2000 Semeyn et al. ..... 251/69
6,276,664 B1 * 8/2001 Keller ..... 251/69

* cited by examiner

*Primary Examiner*—Paul J. Hirsch
(74) *Attorney, Agent, or Firm*—Ronald E. Greigg

(57) ABSTRACT

In a device for restoring a throttle valve, which is for controlling combustion air of an internal combustion engine, into a definite limp-home air position, having a throttle valve shaft, which supports a drivable driver and is rotatably supported in a housing, and having a prestressed clamping spring, whose spring ends, by simultaneously embracing a housing catch and a driver catch on opposing catch surfaces, fix a limp-home air position of the throttle valve, from which the throttle valve can be moved through rotation of the driver , a compensation spring, which has a definite initial stress force directed counter to the spring force of the clamping spring, is disposed between one spring end of the clamping spring and a catch surface on one of the catches in order to produce a rotary play-free state of the driver in the limp-home air position.

20 Claims, 4 Drawing Sheets

THROTTLE VALVE RESTORING DEVICE

CROSS-REFERENCE TO RELATED APPLICATIONS

This application is a 35 U.S.C. 371 application of PCT/DE 01/01063, filed on Mar. 20, 2001.

BACKGROUND OF THE INVENTION

1. Field of the Invention

The invention is based on device for restoring a throttle valve, which is for controlling the combustion air of an internal combustion engine, into a limp-home air position.

2. Description of Prior Art

In the event of a failure of the drive mechanism for the driver on the throttle valve shaft, which drive mechanism is an electric motor, for example, a restoring device of this kind is used to restore the throttle valve into a definite idle position, the so-called limp-home air position or limp-home position, in which a minimal throttle valve opening for the supply of combustion air to the internal combustion engine is assured so that the engine continues to run smoothly at idle speed or at a minimal load.

Due to tolerances in the housing-and driver catch and due to the bending precision of the bent spring ends of the clamping spring, in the limp-home air position, in which the driver catch and the housing catch are disposed radially offset from and approximately congruent to each other, there is a certain rotary play in the throttle valve shaft, which renders a precise regulation impossible in this range.

In a known restoring device disclosed in DE 197 35 046 A1, in order to achieve a rotary play-free embodiment with a definite idle position of the catches in the limp-home air position, oblique catch surfaces are provided on the housing catch and the driver catch. The one spring end of the clamping spring is secured to the oblique catch surfaces on the one side and the other spring end of the clamping spring is secured to the flat catch surfaces extending parallel to the catch axis, on the other side from the housing catch and the driver catch. Because of the oblique catch surfaces, the spring end is supported with half of the respective spring force against the two oblique catch surfaces and thus moves the rotatable driver catch in relation to the catch formed by the spring end on the other side of the housing catch and driver catch.

SUMMARY OF THE INVENTION

The restoring device according to the invention has the advantage that the rotary play-free state in the limp-home air position is reliably achieved with technically simple means. The compensation spring can be produced as a simple stamped part and is easy to install. The additional manufacturing costs for producing a reliable play-free state are therefore minimal.

BRIEF DESCRIPTION OF THE DRAWINGS

The invention will be explained in detail in the description below in conjunction with exemplary embodiments shown in the drawings, in which.

DESCRIPTION OF THE PREFERRED EMBODIMENTS

Figure 6:
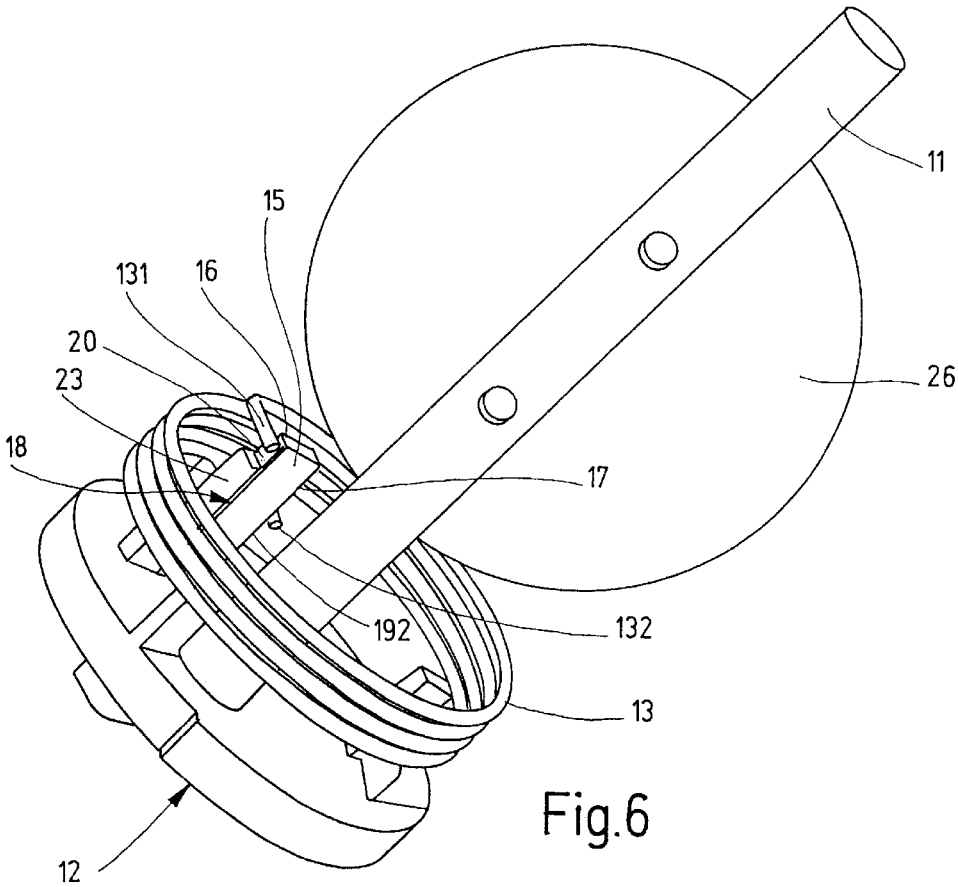
FIG. 6 is a perspective representation of a subassembly of a modified device for restoring a throttle valve, FIGS. 7 and 8 each show a sectional view equivalent to FIGS. 2 and 3 of the modified restoring device.
Figure 7:
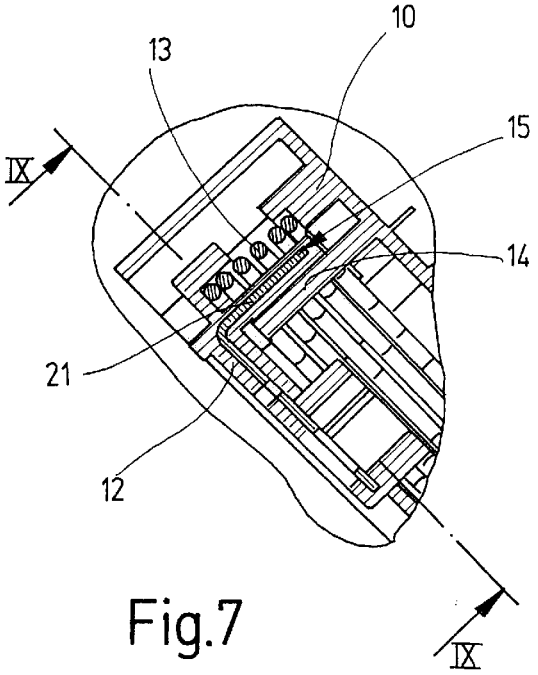
Figure 8:
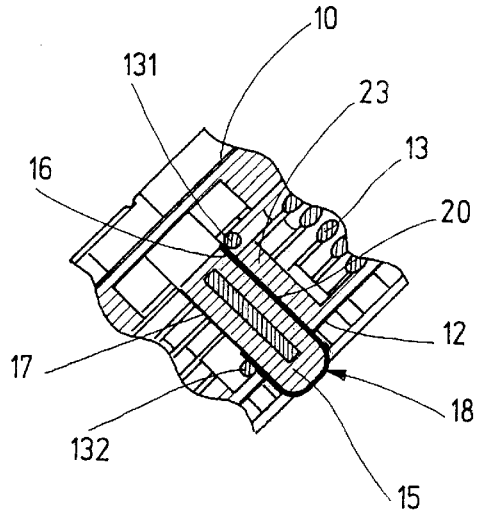
Figure 9:
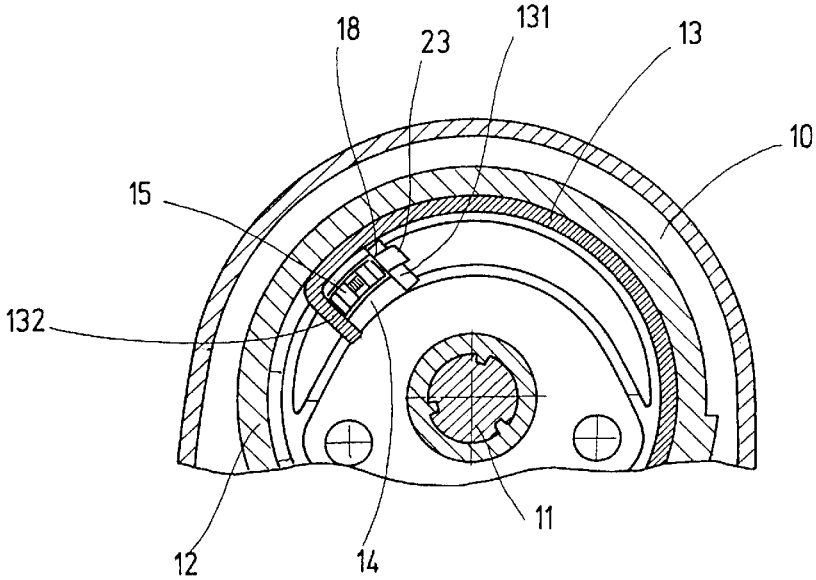
FIG. 9 shows a detailed section along the line IX—IX in FIG. 7.

The device for restoring a throttle valve, which is for controlling combustion air of an internal combustion engine, into a definite limp-home air position or limp-home position, a first exemplary embodiment of which is shown in FIGS. 1–4 and a modified exemplary embodiment of which is shown in FIGS. 7–9, which are respectively depicted in detail in a side view and in various sectional views, has a throttle valve shaft 11, which is contained so that it can rotate in a housing and which non-rotatably supports a throttle valve 26 that is only shown in FIG. 6. As is known, the throttle valve 26 is disposed in an air intake fitting of the internal combustion engine and by opening the intake cross section in the intake fitting to a greater or lesser degree, controls the combustion air quantity aspirated by the internal combustion engine. In order to be driven, the throttle valve shaft 11 has a driver catch 12 rigidly connected to it, which is actuated by a drive mechanism. Preferably, the driver catch 12 has a toothed segment that engages with a gear (not shown) supported on the driven shaft of an electric motor.

Figure 1:
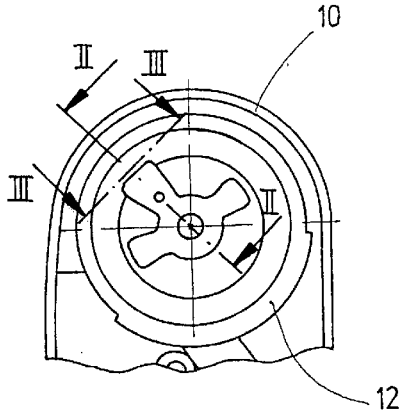
FIG. 1 shows a detailed side view of a device for restoring a throttle valve.
Figure 2:
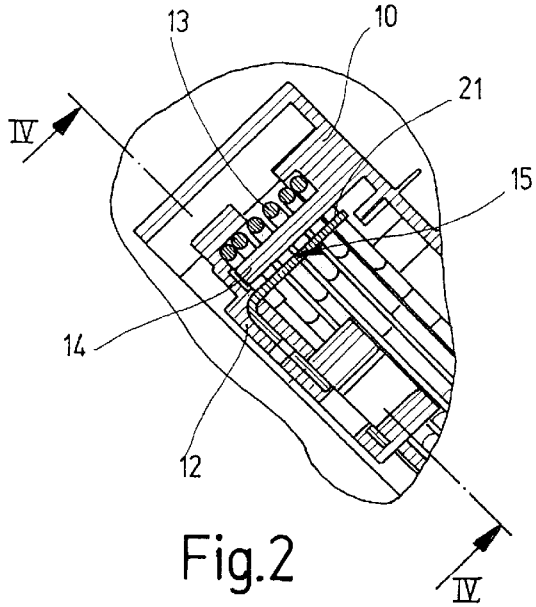
FIG. 2 shows a detailed section along the line II—II in FIG. 1.

The housing 10 contains a clamping spring 13, which is embodied as a cylindrical helical compression spring and is disposed concentric to the throttle valve shaft 11 and whose spring ends 131 and 132 are bent toward the throttle valve shaft 11. The clamping spring 13, which is shown in a perspective view in FIG. 6, is already prestressed in the depiction in FIG. 6, so that the two inwardly directed spring ends 131, 132 protrude crosswise and extend approximately parallel to each other. This initial stress produces a force so that a part inserted between the spring ends 131, 132 is clamped in place. As can also be seen in FIG. 4 and FIG. 9, two catches 14, 15, which are constituted by axial pieces and are radially offset from each other, are clamped between the two spring ends 131, 132 of the clamping spring 13 and both extend over at least the axial width of the clamping spring 13, and on opposite sides in the rotation direction, have respective catch surfaces 16, 17 for the spring ends 131 and 132. The catch 14, referred to below as the housing catch 14, is connected to the housing 10, and the catch 15, referred to below as the driver catch 15, is connected to the driver 12. As can be seen from FIGS. 2 and 3 as well as FIGS. 7 and 8, the axial piece constituting the housing catch 14 is of one piece with the housing 10 and protrudes axially from the bottom of the housing 10. The driver catch 15 in FIG. 2 is constituted by an angled leg of a bent metal part 21, whose other angled leg is injection molded into the plastic driver 12, whereas the driver catch 15 in FIGS. 8 and 9 is embodied as an axial piece, which is reinforced through the extrusion coating of the likewise inserted angled metal part 21 and is injection molded directly onto—and at the same time as—the driver 12. The length of the two bent spring ends 131, 132 of the clamping spring 13 is dimensioned so that of they are able to embrace catch surfaces 16, which each face in the same rotation direction on the one side the housing catch 14 and the driver catch 15, and the catch surfaces 17 on their other sides remote from the catch surfaces 16.

If the driver 12 is rotated by the drive mechanism, e.g. the electric motor, in the one or the other rotation direction, then as the driver 12 rotates clockwise (in relation to FIG. 1), the driver catch 15 entrains the spring end 131 of the clamping spring 13, and as the driver 12 rotates counter-clockwise (in relation to FIG. 1), the driver catch 15 entrains the spring end 132 of the clamping spring 13, and increasing stress is exerted on the clamping spring 13. If the drive mechanism malfunctions, e.g. if the electric motor loses its power supply, then the driver 12 is turned back by the restoring force of the clamping spring 13, in the one case, counter-clockwise (in relation to FIG. 1) until the spring end 131 comes into contact with the housing catch 14 and in the other case, clockwise (in relation to FIG. 1) until the spring end 132 respectively comes into contact with this housing catch 14. In this position of the driver 12, the throttle valve 26, which is entrained by means of the throttle valve shaft 11, assumes a definite position, the so-called limp-home air position or limp-home position, in which a definite opening of the throttle valve 26 is preset so that the internal combustion engine receives enough combustion air and continues to run smoothly at idle speed or at a minimum load.

Due to tolerances in the two catches 14, 15 and due to the limited bending precision of the spring ends 131, 132, in the limp-home air position of the catches 14, 15, which is determined by the limp-home air position of the throttle valve shaft 11 and in which these catches 14, 15 are aligned one outside the other in the radial direction, there is a certain amount of rotary play which renders a precise regulation of the internal combustion engine impossible in this range. This play is due, for example, to tolerances in the distance, viewed in the rotation direction, between the catch surfaces 16 and 17 on the housing catch 14 on the one hand and on the driver catch 15 on the other, i.e. is due to tolerances in the width, viewed in the rotation direction, of the axial pieces constituting the catches 14, 15, and is due to tolerances in the bending angle of the spring ends 131, 132 so that these spring ends do not rest flat against the catch surfaces 16 or 17 of the two catches 14, 15, but lean more or less toward them. The spring ends 131, 132 then rest, for example, only against the catch surfaces 16, 17 of the housing catch 14 or against the catch surfaces 16, 17 of the driver catch 15 and the driver 12 is not fixed in a rotary play-free fashion in the limp-home air position. In order to suppress the rotary play, a play neutralizing spring or compensation spring 18 is disposed between one spring end 131, 132 and a catch surface 16, 17 on one of the catches 14, 15, with an initial stress directed counter to the restoring force of the clamping spring 13.

In the exemplary embodiment of FIGS. 1–4, the compensation spring 18 is disposed on the housing catch 14 and lies between the catch surface 16 on the housing catch 14 and the spring end 131 of the clamping spring 13, and in the exemplary embodiment of FIGS. 6–9, the compensation spring 18 is disposed on the driver catch 15 and lies between the catch surface 16 on the driver catch 15 and the spring end 131 of the clamping spring 13. In both cases, the initial stress of the compensation spring 18 is determined so that it is ideally half as great as the initial stress of the clamping spring 13 in the limp-home air position.

Figure 4:
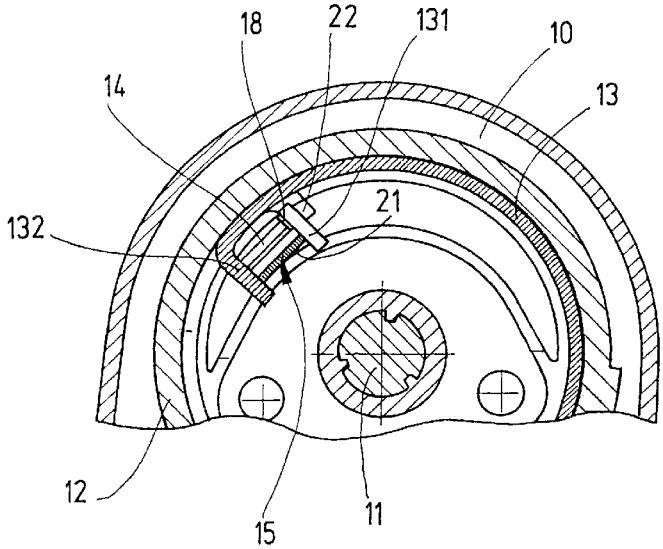
FIG. 4 shows a detailed section along the line IV—IV in FIG. 2.
Figure 5:
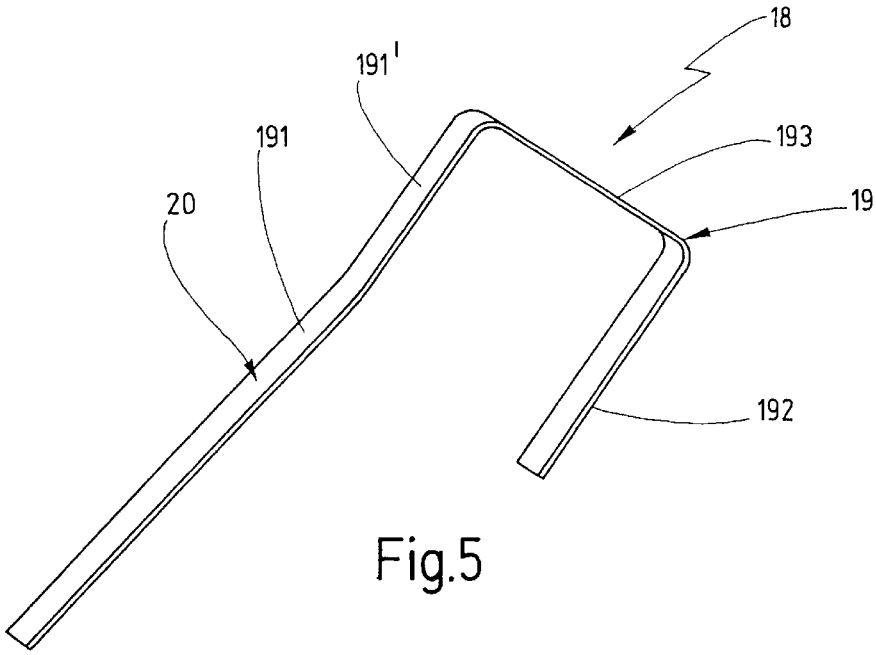
FIG. 5 is an enlarged perspective representation of a compensation spring in the restoring device according to FIGS. 1–4 or according to FIGS. 6–9.

In the exemplary embodiments described here, the compensation spring 18, which is shown in an enlarged perspective representation in FIG. 5, has a spring bracket 19 bent into a U-shape, with a long leg 191 and a short leg 192. The two legs 191, 192 are of one piece with each other, connected by means of a crosspiece 193. The long leg 191 is bent outward spaced apart from the crosspiece 193, the bent leg section forming a spring leaf 20, which rests between the catch surface 16 of the housing catch 14 (FIGS. 1–4) or of the driver catch 15 (FIGS. 6–9) and the spring end 131 of the clamping spring 13, with an initial stress directed against the spring end 131. The compensation spring 18 is placed against the housing catch 14 (FIGS. 1–4) or against the driver catch 15 (FIGS. 6–9) so that the short, rigid leg 192 rests against the catch surface 17 and the likewise rigid leg section 191' of the long leg 191, which is disposed underneath the bend point, rests against the opposite catch surface 16 of the housing catch 14 (FIGS. 1–4) or of the driver catch 15 (FIGS. 6–9), preferably with a contact force.

In order to adjust the initial stress of the spring leaf 20, a spring catch 22 or 23 is respectively embodied on the housing 10 in the exemplary embodiment of FIGS. 1–4 or on the driver 12 in the exemplary embodiment of FIGS. 6–9, which catch is disposed at a definite distance, viewed in the rotation direction, from the catch surface 16 of the housing catch 14 or the driver catch 15, and which is contacted with initial stress by the spring leaf 20 at or near its free end. The distance of the spring catch 22 or 23 from the catch surface 16 of the housing catch 14 or the catch surface 16 of the driver catch 15 simultaneously determines the range of motion of the spring leaf 20, i.e. the spring path of the spring leaf 20. For the play compensation, it is thus essential that, viewed in the rotation direction, the width of the axial piece, which constitutes the catch 14 or 15 that does not support the compensation spring 18, is at least equal to or slightly greater than the width of the axial piece, which constitutes the other catch 15 or 14 and whose width is enlarged by the thickness of the spring leaf 20, which other catch does support the compensation spring 18, this taking into account the permissible tolerances for the axial piece width.

As mentioned above, in the limp-home air position, the two catches 14, 15 are disposed one outside the other in the radial direction, and the clamping spring 13 affixes the driver 12 to the housing 10 by means of its spring ends 131, 132 that embrace the two respective catch surfaces 16, which are disposed on the one side of the driver catch 15 and the housing catch 14, and the two catch surfaces 17, which are disposed on the other side of the driver catch 15 and the housing catch 14. At the same time, the compensation spring 18 presses with its spring leaf 20 against the clamping spring 13 and likewise produces an initial stress so that the driver 12 is prestressed in both directions and no rotary play of the driver 12 can occur in the limp-home air position. In the range of motion of the spring leaf 20, which is defined by the distance of the spring catch 22 or 23 from the housing catch 14 or the driver catch 15, the moment required to deflect the driver 12 is only approximately half as great as the moment-required to deflect the clamping spring 13.

Figure 3:
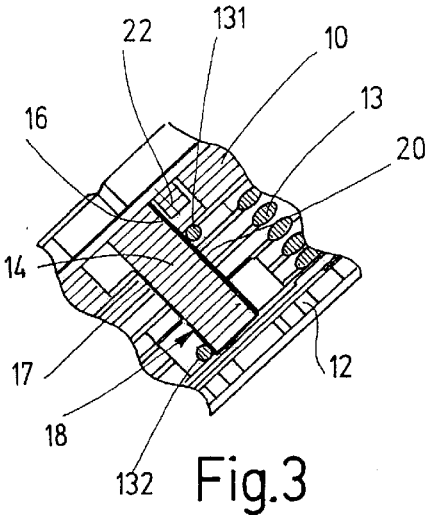
FIG. 3 shows a detailed section along the line III—III in FIG. 1.

The modified restoring device for the throttle valve 26, which device is shown in a perspective representation in FIG. 6 with its housing removed and is shown in sectional views in FIGS. 7–9 similar to those shown in FIGS. 2–4, is also modified in relation to the restoring device from FIGS. 1–4 in ways beyond that which has already been described insofar as by contrast with the restoring device from FIGS. 1–4, the housing catch 14 is not disposed with a greater radial distance from the housing axis 10, but with a lesser radial distance from this axis than the driver catch 15 is disposed from the throttle valve shaft 11 so that in the limp-home air position, the driver catch 15 is disposed outside of the housing catch 14, viewed in the radial direction.

For better comprehension of the restoring device shown in FIGS. 7–9, FIG. 6 gives a three-dimensional representation of the subassembly comprised of the driver 12, the throttle valve shaft 11, the throttle valve 26 non-rotatably supported by it, and the clamping spring 13. The driver catch 15, which is embodied as an axial piece protruding from the driver 12, supports the compensation spring 18, whose spring leaf 20 is disposed between the spring end 131 of the clamping spring 13 and the catch surface 16 on the driver catch 15. The spring leaf 20 is supported close to its free end on the spring catch 23 that is affixed to the driver 12. The rigid, short leg 192 of the compensation spring 18, which is embodied as a U-shaped spring bracket 19, rests with frictional engagement against the catch surface 17, and the leg section 191', which is disposed between the spring leaf 20 and the crosspiece 193 of the spring bracket 19, rests with frictional engagement against the catch surface 16 of the driver catch 15.

The action of the compensation spring 18, which is disposed against the driver catch 15 and is used to produce a play-free state of the driver 12 in the limp-home air position, functions as described above.

Figure 10:
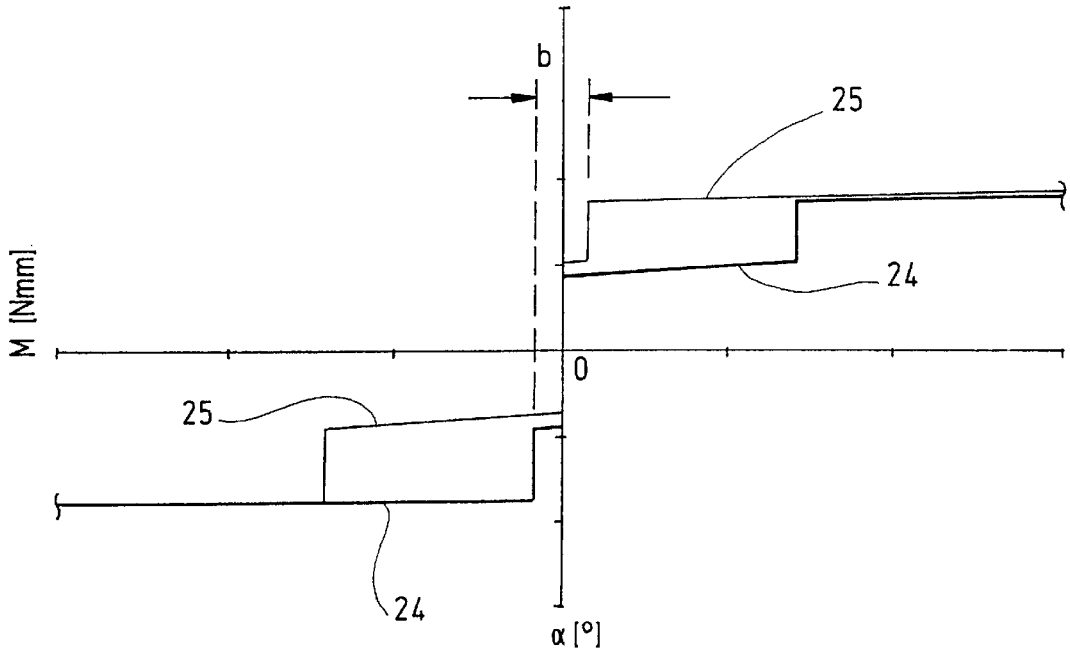
FIG. 10 shows a detail of a graph of the moment progression of the restoring device on the throttle valve over its rotation angle.

The action of the compensation spring 18 is clearly shown by the graph depicted in FIG. 10. The moment progression M of the restoring device on the throttle valve 26 is plotted there as a function of the rotation angle $\alpha$ of the throttle valve shaft 11, in a sector in the vicinity of the low rotation angles around the limp-home air point of 0°. The heavy solid characteristic curve 24 represents the moment progression with maximal play between the catches 14, 15, which is produced when the greatest width of the axial piece constituting the housing catch 14, viewed in the rotation direction, and the smallest width of the axial piece constituting the driver catch 15, or vice versa, are encumbered with tolerances. The lighter solid characteristic curve 25 represents the moment progression with minimal play of the catches 14, 15, which is produced when there are extremely low tolerances between the catches 14, 15. Without the compensation spring 18, there would be no torque in the rotation angle range b around the limp-home air point of 0° so that the throttle valve 26 would flutter and an exact regulation of the internal combustion engine would not be possible. As a result of the initial stress exerted on the clamping spring 13 by the compensation spring 18, a torque acts on the throttle valve 26 in this region and it is possible for a regulation to be carried out in the rotation angle range b.

The foregoing relates to preferred exemplary embodiments of the invention, it being understood that other variants and embodiments thereof are possible within the spirit and scope of the invention, the latter being defined in the appended claims.

We claim:

1. A device for restoring a throttle valve (26) for controlling combustion air of an internal combustion engine, into a definite limp-home air position, the device comprising a throttle valve shaft (11) that supports the throttle valve (26) and is rotatably supported in a housing (10), a drivable driver (12), which is non-rotatably supported on the throttle valve shaft (11), a prestressed clamping spring (13), whose spring ends (131, 132), by simultaneously embracing a housing catch (14) affixed to the housing (10) and a driver catch (15) affixed to the driver (12) on opposing catch surfaces (16, 17) of the catches (14, 15), fix the limp-home air position of the throttle valve (26) from which the throttle valve (26) can be moved through rotation of the driver (12), and a compensation spring (18), which has an initial stress force directed counter to the spring force of the clamping spring (13), said compensation spring being disposed between one spring end (131) of the clamping spring (13) and a catch surface (16) on one of the two catches (14, 15).

2. The device according to claim 1, wherein the catches (14, 15), which are respectively embodied as axial pieces protruding from the housing (10) and the driver (12), are disposed radially offset from each other and extend over at least the axial width of the clamping spring (13), which is embodied as a cylindrical helical compression spring and is disposed coaxial to the throttle valve shaft (11), that the catch surfaces (16, 17) are embodied on opposite sides of the axial pieces, viewed in the rotation direction, and that the spring ends (131, 132) of the clamping spring (13), which are directed inward toward the throttle valve shaft (11), respectively protrude across the catch surfaces (16, 17), which are disposed on the same sides of the axial pieces.

3. The device according to claim 1, wherein the compensation spring (18) is disposed against one of the catches (14, 15) and has a spring leaf (20) placed in front of the catch surface (16) of the catch (14, 15), which spring leaf (20), on its one leaf end, is affixed to the catch (14, 15), and at or near its other free leaf end, rests with an initial stress against a spring catch (22, 23), which is disposed spaced apart from the catch surface (16) and determines the spring path of the spring leaf (20).

4. The device according claim 2, wherein the compensation spring (18) is disposed against one of the catches (14, 15) and has a spring leaf (20) placed in front of the catch surface (16) of the catch (14, 15), which spring leaf (20), on its one leaf end, is affixed to the catch (14, 15), and at or near its other free leaf end, rests with an initial stress against a spring catch (22, 23), which is disposed spaced apart from the catch surface (16) and determines the spring path of the spring leaf (20).

5. The device according to claim 3, wherein the compensation spring (18) comprises a spring bracket (19), which is bent into a U-shape having one long and one short bracket leg (191, 192), which are connected by means of a crosspiece (193), the long bracket leg being bent outward spaced apart from the crosspiece (193), the bent bracket leg section (191') constituting the spring leaf (20).

6. The device according to claim 4, wherein the compensation spring (18) comprises a spring bracket (19), which is bent into a U-shape having one long and one short bracket leg (191, 192), which are connected by means of a crosspiece (193), the long bracket leg being bent outward spaced apart from the crosspiece (193), the bent bracket leg section (191') constituting the spring leaf (20).

7. The device according to claim 5, wherein the compensation spring (18) is placed against the catch (14, 15) so that the short bracket leg (192) and the bracket leg section (191'), which is disposed below the bending point and adjoins the crosspiece (193), rest against the opposing catches surfaces (16, 17) of the catches (14, 15), preferably in a frictionally-engaging manner.

8. The device according to claim 6, wherein the compensation spring (18) is placed against the catch (14, 15) so that the short bracket leg (192) and the bracket leg section (191'), which is disposed below the bending point and adjoins the crosspiece (193), rest against the opposing catches surfaces (16, 17) of the catches (14, 15), preferably in a frictionally-engaging manner.

9. The device according to claim 3, wherein the compensation spring (18) is disposed against the housing catch (14) and the spring catch (22) for the spring leaf (20) is embodied on the housing (10).

10. The device according to claim 4, wherein the compensation spring (18) is disposed against the housing catch (14) and the spring catch (22) for the spring leaf (20) is embodied on the housing (10).

11. The device according to claim 5, wherein the compensation spring (18) is disposed against the housing catch (14) and the spring catch (22) for the spring leaf (20) is embodied on the housing (10).

12. The device according to claim 6, wherein the compensation spring (18) is disposed against the housing catch (14) and the spring catch (22) for the spring leaf (20) is embodied on the housing (10).

13. The device according to claim 7, wherein the compensation spring (18) is disposed against the housing catch (14) and the spring catch (22) for the spring leaf (20) is embodied on the housing (10).

14. The device according to claim 8, wherein the compensation spring (18) is disposed against the housing catch (14) and the spring catch (22) for the spring leaf (20) is embodied on the housing (10).

15. The device according to claim 3, wherein the compensation spring (18) is disposed against the driver catch (15) and the spring catch (22) for the spring leaf (20) is embodied on the driver (12).

16. The device according to claim 5, wherein the compensation spring (18) is disposed against the driver catch (15) and the spring catch (22) for the spring leaf (20) is embodied on the driver (12).

17. The device according to claim 6, wherein the compensation spring (18) is disposed against the driver catch (15) and the spring catch (22) for the spring leaf (20) is embodied on the driver (12).

18. The device according to claim 1, wherein the initial stress force of a spring leaf (20) of the compensation spring (18) is approximately half as great as the initial stress force of the clamping spring (13) in the limp-home air position of the throttle valve shaft (11).

19. The device according to claim 2, wherein the initial stress force of a spring leaf (20) of the compensation spring (18) is approximately half as great as the initial stress force of the clamping spring (13) in the limp-home air position of the throttle valve shaft (11).

20. The device according to claim 3, wherein the initial stress force of the spring leaf (20) of the compensation spring (18) is approximately half as great as the initial stress force of the clamping spring (13) in the limp-home air position of the throttle valve shaft (11).

* * * * *